US007481192B2

(12) United States Patent
Truijens

(10) Patent No.: US 7,481,192 B2
(45) Date of Patent: Jan. 27, 2009

(54) VALVE GEAR AND METHOD FOR OPENING AND CLOSING A PASSAGE

(76) Inventor: Franklin Hubertus Truijens, Lage Vuurscheweg 3, NL-1251 TS Laren (NL)

( * ) Notice: Subject to any disclaimer, the term of this patent is extended or adjusted under 35 U.S.C. 154(b) by 219 days.

(21) Appl. No.: 10/553,247

(22) PCT Filed: Jun. 20, 2003

(86) PCT No.: PCT/NL03/00458

§ 371 (c)(1),
(2), (4) Date: Sep. 14, 2006

(87) PCT Pub. No.: WO2004/092550

PCT Pub. Date: Oct. 28, 2004

(65) Prior Publication Data

US 2007/0199528 A1 Aug. 30, 2007

(30) Foreign Application Priority Data

Apr. 17, 2003 (NL) ..... 1023209

(51) Int. Cl.
*F01L 1/30* (2006.01)

(52) U.S. Cl. ..... 123/90.24; 123/90.12

(58) Field of Classification Search ..... 123/90.11, 123/90.12, 90.13, 90.24
See application file for complete search history.

(56) References Cited

U.S. PATENT DOCUMENTS 4,061,115 A 12/1977 Predhome, Jr.
4,942,852 A * 7/1990 Richeson et al. ..... 123/90.14
5,152,260 A * 10/1992 Erickson et al. ..... 123/90.12
5,572,961 A * 11/1996 Schechter et al. ..... 123/90.12

FOREIGN PATENT DOCUMENTS

DE 31 39 399 A1 4/1983
EP 0 569 088 A1 5/1993

OTHER PUBLICATIONS

International Search Report.

* cited by examiner

*Primary Examiner*—Ching Chang
(74) *Attorney, Agent, or Firm*—Harness, Dickey & Pierce, P.L.C.

(57) ABSTRACT

A valve gear includes a housing provided with a passage, a valve member arranged within the housing, which is movable between a first, closed position, in which the passage is closed, and a second, open position, a piston connected to the valve member, which can oscillate in an at least substantially closed piston chamber, and a locking device which are capable of holding the valve member periodically in the closed position. The piston chamber is provided with at least three closable openings, which may each be in communication with a gas pressure device. The first opening and the second opening are each in communication with another part of the piston chamber separated therefrom by the piston, and which are open when the valve member is held in the closed position, and wherein the third opening is open during movement of the piston.

10 Claims, 4 Drawing Sheets

VALVE GEAR AND METHOD FOR OPENING AND CLOSING A PASSAGE

The present invention relates to a valve gear comprising a housing provided with a passage, a valve member arranged within said housing, which is movable between a first, closed position, in which the passage is closed, and a second, open position. Such a valve gear is used inter alia in combustion engines, in piston expansion machines and in compressors.

A problem that occurs with known valve gears is that the valve member opens and closes slowly, which limits the range of applications thereof.

German patent application No. 31 39 399 provides a valve gear for a combustion engine, which comprises a valve member which, being spring-supported, is capable of vibrating with an eigenfrequency, locking means comprising passive elements for locking the valve member, and initiating means being controllable from outside the system for releasing the locking means. Energy for maintaining the movement of the valve member is supplied by a piston. This known valve gear is complicated, however, its energy consumption is not very efficient, and the duration of opening of the valve member is relatively long.

The object of the present invention is to overcome one or more of the above drawbacks.

To that end the valve gear according to the invention comprises a piston connected to the valve member, which can oscillate in an at least substantially closed piston chamber, and locking means which are capable of holding the valve ember periodically, and preferably exclusively, in the closed position, wherein the piston chamber is provided with at least three closable openings, which may each be in communication with gas pressure means, wherein the first opening and the second opening are each in communication with another part of the piston chamber separated therefrom by the piston, and which are open when the valve member is held in the closed position, and wherein the third opening is open during movement of the piston. In this way gas pressure means can adjust predetermined gas pressure levels on either side of the piston through said first and said second opening during the period that the valve member is held in the closed position, wherein gas is supplied to the piston chamber or discharge therefrom through said third opening during the movement of the piston.

The pressure levels and the supply and/or discharge of gas can be controlled for regulating the duration of opening, the supply and/or discharge of energy and the extent to which the valve opens. In addition, the valve gear is faster than the prior art valve gears, which renders it suitable for pre-compressed mixtures, for example, so that the combustion process takes place more efficiently.

Preferably, the first and the third opening are in communication with the part of the piston chamber remote from the valve member. The preset gas pressure level in the part of the piston chamber remote from the valve member is preferably higher than that in the part facing towards the valve member, for example 40 bar and 8 bar, respectively. Preferably, gas is discharged from the part of the piston chamber remote from the valve member during movement of the piston. As a result, the pressure within said space during the return movement will be lower than during the inward movement, and energy will be supplied to the piston. The pressure within said space is restored during the period that the valve member is closed. Conversely, it is also possible, by setting a higher value for the third pressure, to allow gas to flow into said space and thus achieve a higher pressure than the first set pressure after the return movement. This may be necessary in some processes, if the valve member absorbs too much kinetic energy.

Preferably, the locking means comprise a projection and a curved guideway, which are movable relative to each other, wherein the part of the guideway against which the projection abuts in the closed position of the valve member extends substantially transversely to the direction of movement of the valve member, in such a manner that the movement of the valve member is blocked. Furthermore, the locking means preferably comprise a tappet, which is capable of striking against the projection and/or the guideway to release the locked position thereof. The guideway is preferably formed in a rotatable sleeve, which can rotate around a stem within the housing, with said stem preferably linking the valve member and the piston together. The sleeve, the piston and/or the stem are preferably made of a light but nevertheless strong material, such as foamed aluminium or plastic, so as to reduce the mass inertia and/or the mass moment of inertia.

The piston chamber and the valve member are preferably present in separate parts of the housing, which parts are resiliently connected, preferably by means of an elastic ring. In this way the valve member is prevented from striking the valve seat violently with every cycle, which mighty eventually lead to the valve member breaking off. In addition, this achieves that the locking means can return to the locked position before the valve member fully closes the passage.

The invention also relates to a method for opening and closing a passage, wherein a valve member mounted within a housing is reciprocated between a first, closed position, in which the passage is closed, and a second, open position, by means of a piston connected to the valve member, which piston oscillates within an at least substantially closed piston chamber, wherein locking means periodically hold the valve member in the closed position, and wherein the piston chamber is connected to gas pressure means, which set predetermined gas pressure levels on either side of the piston during the period that the valve member is held in the closed position, and wherein the gas is supplied to the piston chamber or discharged from the piston chamber during movement of the piston.

The invention furthermore relates to a valve gear, whether or not in combination with the aforesaid aspects, comprising a housing provided with a passage, a valve member mounted within said housing, which is movable between a first, closed position, in which the passage is closed, and a second, open position, and locking means capable of periodically holding the valve member in the closed position, wherein the locking means comprise a projection and a curved guideway, which are movable relative to each other, wherein the part of the guideway against which the projection abuts in the closed position of the valve member extends substantially transversely to the direction of movement of the valve member in the closed position of the valve member, in such a manner that the valve member is locked against movement.

The invention furthermore relates to a valve gear, whether or not in combination with the aforesaid aspects, comprising a housing provided with a passage, a valve member mounted within said housing, which is movable between a first, closed position, in which the passage is closed, and a second, open position, a piston connected to the valve member, which can oscillate in an at least substantially closed piston chamber, wherein the piston chamber and the valve member are preferably present in separate parts of the housing, which housing parts are resiliently connected, preferably by means of an elastic ring.

The valve gears as described above are for example used in lift valves and slide valves as used in piston combustion engines, piston compressors and piston expansion machines.

The invention will now be explained in more detail by means of an embodiment as shown in the Figures, in which.

Like parts are indicated by the same numerals in the Figures.

Figure 1A:
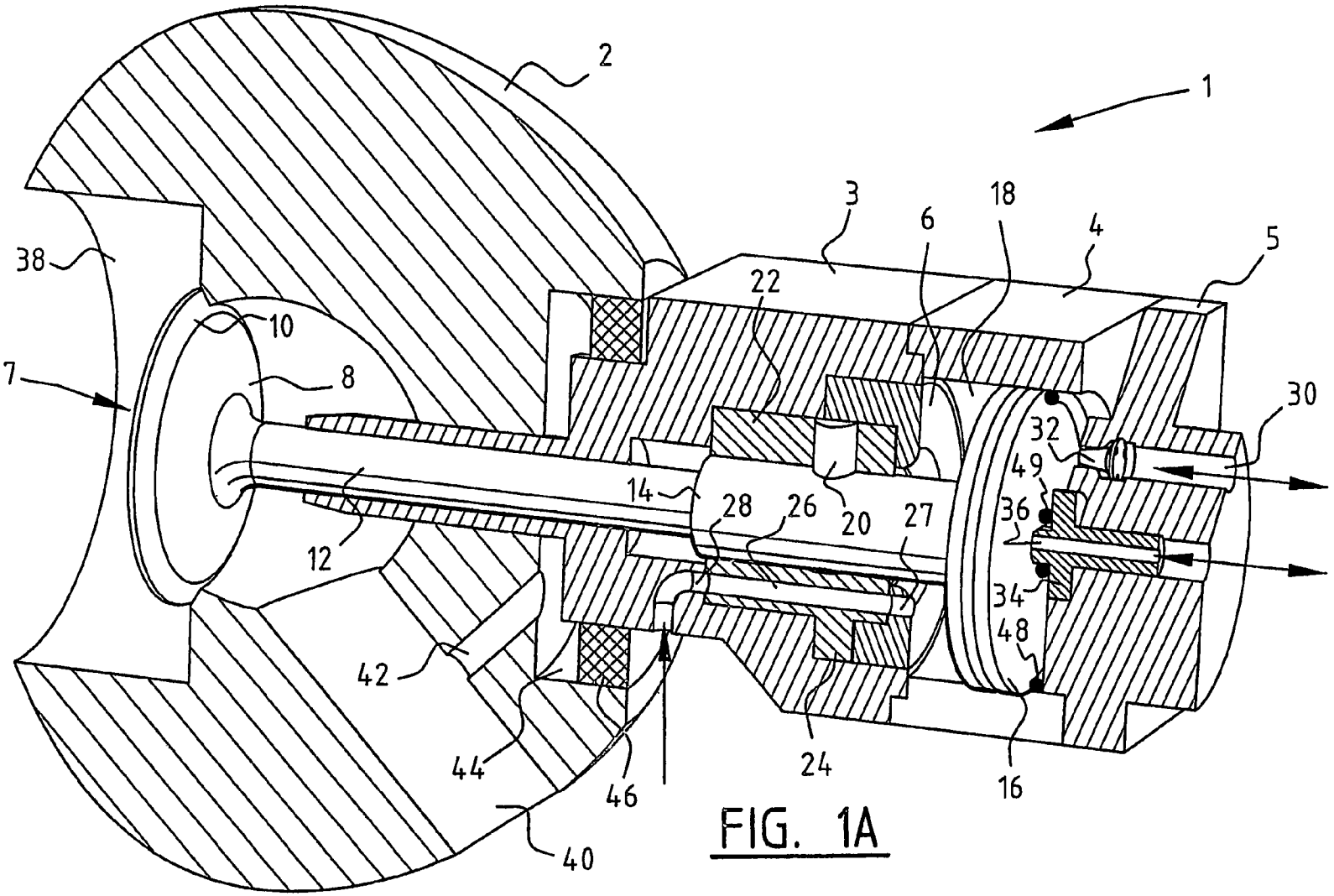
FIG. 1A is a perspective, sectional view of a preferred embodiment of a valve gear according to the present invention in a first, closed position thereof.
Figure 1B:
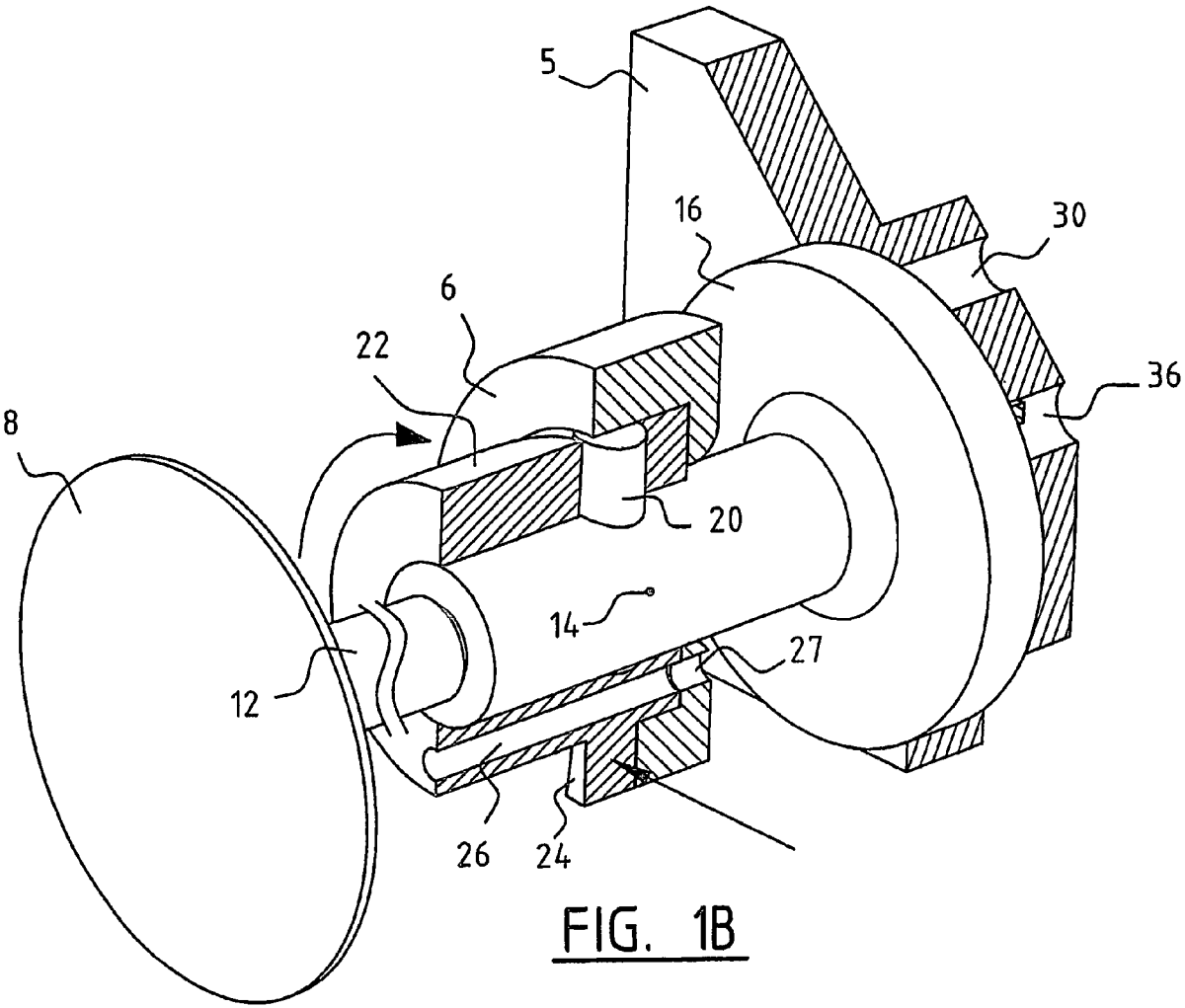
FIG. 1B is a perspective view of part of the valve gear of FIG. 1A.

A valve gear 1 comprises a housing comprised of house parts 2, 3, 4, 5, in which a valve 7 is mounted, which valve comprises a valve member 8, which closes the opening 10 of the house part 2 in the position of use as shown. The valve 7 furthermore comprises a stem built up of valve stem portions 12 and 14, and a piston 16 mounted on one end of the valve stem 14, which is movable within the cylindrical space 18. A projection 20 is formed on the valve stem portion 14, which projection partially extends in radial direction, and which fits in a guideway 21 formed in locking means which, in the illustrated embodiment, comprise a cylinder 22 rotatably disposed within the housing part 3, on which a radially extending projection 24 is formed. A channel 26 is formed in a wall of the cylinder, parallel to the axis thereof, which channel connects to the channel 28 in the housing part 3 in the position of use as shown. The channel 26 connects to the space 18 with its other end 27. At the other side of the piston 16, the channel 32 formed in the housing part 5 opens into the space 18, which is closed by the valve 32. The valve 32 is opened as a result of the piston 16 pushing against a projection on the valve 32, which extends into the piston chamber. In another embodiment the valve 32 can be actuated by external actuating means.

Centrally provided in the piston 16 is a cavity, via which the piston 16 fits round a fixing pin 34, in which fixing pin a channel 36 is formed, which channel is connected to a third gas reservoir (not shown). The unround fixing pin 34 fits the cavity of the piston 16 with a close fit and prevents the piston rotating about the axis of movement. Sufficient space is present between the fixing pin 34 and a wall of the cavity on the side of the mouth of channel 36 for allowing gas to flow into or out of the space 18 of via the channel 36. In the stable first, closed position, the gas is shut off by sealing rings 48, 49 disposed between the piston 16 on the one hand and the end wall of the piston chamber 18 and the pin portion 34, respectively, on the other hand.

The valve member 8 functions to close the opening 10 in the housing part 2 and separates a combustion chamber or working cylinder 38 (only partially shown) from an inlet channel 40. In the preferred embodiment as shown, a channel 42 is furthermore formed in the housing part 2 for the purpose of placing the space 44 in communication with the channel 40 for compensating the force being exerted on the valve member 8 by the pressure that prevails in the channel 40. The spring 46, which may be made of any suitable material, such as rubber or a synthetic material, is biased between the housing part 2 and the housing part 3, so that the valve member presses onto the valve seats of the opening 10 with a predetermined force in the illustrated position of use.

Figure 2A:
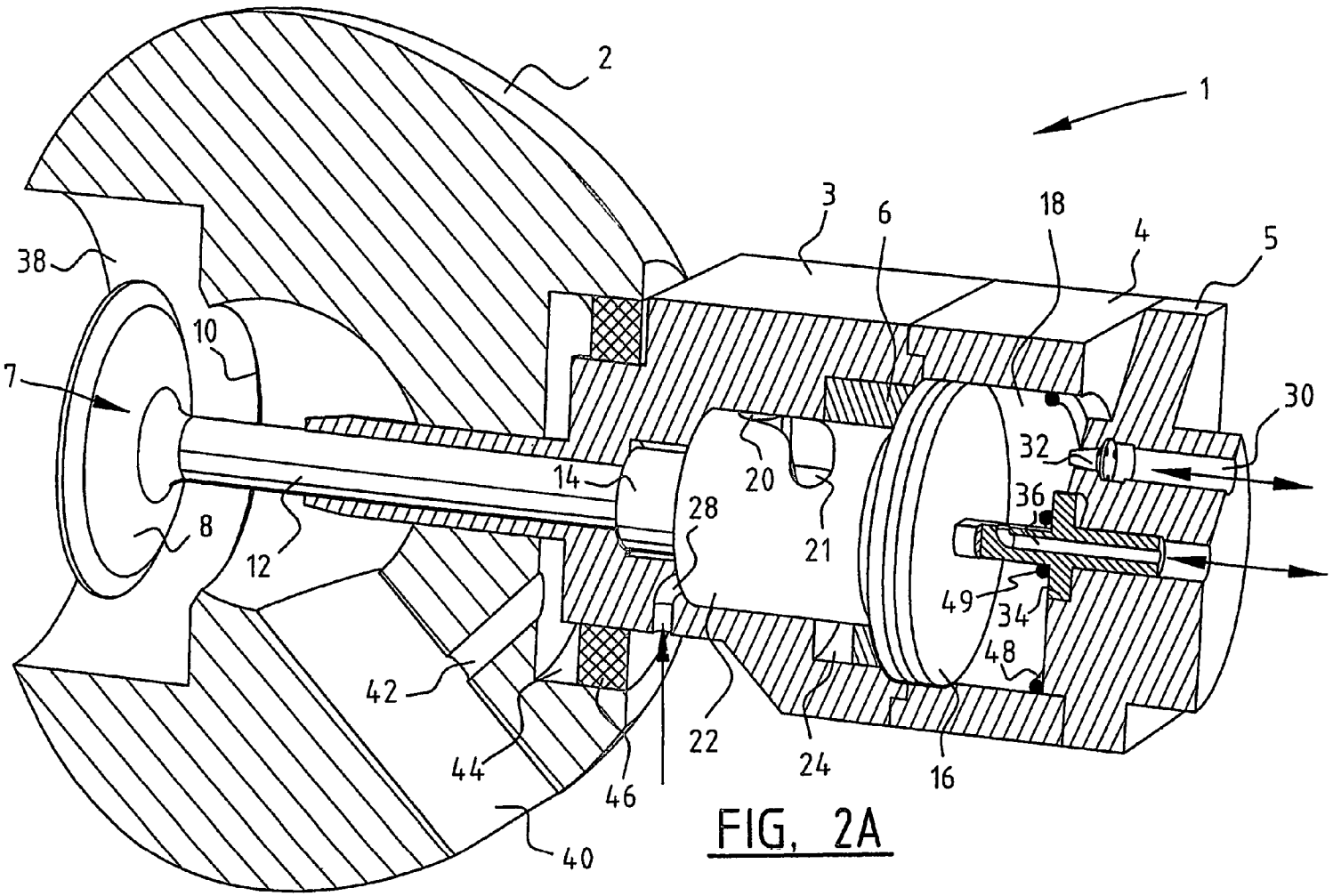
FIG. 2A is a perspective, sectional view of the valve gear of FIG. 1A in a second, open position thereof.
Figure 2B:
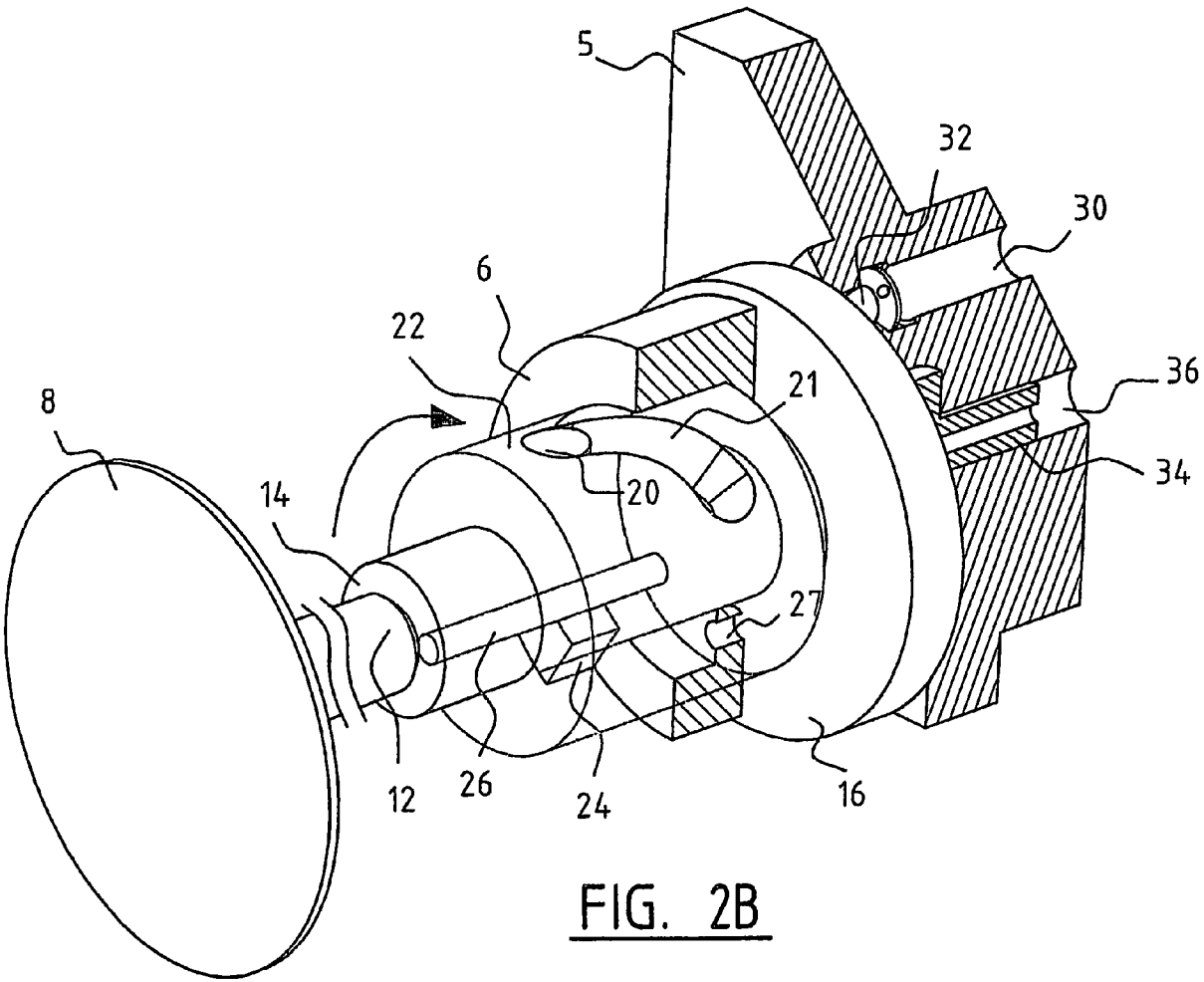
FIG. 2B is a perspective, partially cut-away view of a part of the valve gear of FIG. 2A.

FIGS. 2A and/or B show the valve gear of FIG. 1A in a second position of use thereof, in which the valve member 8 leaves the opening 10 open. The projection 20 is now present at the other end of the guideway 21 formed in the wall of the cylinder 22. In this position of use, the space 18 is furthermore in communication with the third air pressure reservoir (not shown) via the channel 36, and the cylinder 22 is rotated through an angle of about 60' in comparison with the position as shown in FIG. 1A, as a result of which the channel 26 has rotated along therewith, so that said channel is no longer in communication with the space 18 via the opening 27 in the housing part 6.

The cylinder 22 is held in position in axial direction by the housing part 3, 6, being capable of rotation about the longitudinal axis of the valve 7. The cylinder 22 is provided with a concentric bore, within which the piston stem portion 14 can move in longitudinal direction. One end of the guideway 21 present on the side of the piston extends substantially transversely to the longitudinal direction of the valve 7, whilst the other end, which is present on the side of the valve member 8, extends substantially in the longitudinal direction of the valve 7. The valve gear 1 may also be embodied to have two or more projections 20 and two or more corresponding guideways 21. The guideway 21 limits the freedom of movement of the projection 20 between a first, stable position, in which the valve is closed, and a second position, in which the valve 7 is maximally open. The valve 7 is prevented from opening in said first, stable position in that the wall of the guideway 21 exerts a force to the right on the projection 20, substantially perpendicularly to the wall of the guideway 21.

The pressures that prevail in the space 18 to the left and the right of the piston 16 can be separately adjusted during the time that the piston is stationary in the stable position thereof. To the right of the piston 16 a first pressure is built up as a result of a gas being supplied via the channel 30 from a first reservoir (not shown), in which a relatively high pressure prevails, whereas to the left of the piston 16 a second pressure is built up via the channel 26 from a second reservoir (not shown), in which the prevailing gas pressure is lower than the gas pressure in the first reservoir.

As a result of the difference in gas pressure between the left-hand side and the right-hand side of the piston chamber 18, an action force to the left is exerted on the piston 16. When the valve 7 is required to open, initiating means (not shown) mounted in the housing part 3, which may comprise a tappet, after example, will exert a pushing force on the projection 14, as a result of which the locking engagement will be released. The action force will cause the piston to move to the left, seen in FIG. 1A, with the projection 20 moving through the guideway 21, so that the cylinder 22 will make a rotating movement and the communication between the channel 208 and the channel 26 will be interrupted. In addition to that, the valve 32 will be closed.

The proportion between the first high gas pressure, which is set via the channel 30, and the second, lower pressure, which is set via the channel 26, is such that when the gas to the right of the cylinder 16 expands, the gas pressures in the space 18 to the left and to the right of the piston 16 will be substantially in equilibrium when the piston is positioned a substantially in the middle of the space 18. The piston will continue to move on account of the inertia of the mass of the valve 7. The piston 16 will now experience a resulting force from the compressed gas to the left of the piston and the reduced gas pressure to the right of the piston 16 in the direction of the stable first position, so that the piston will return to the first position after having travelled its maximum distance. The maximum amount of travel is determined by the first, the second and the third gas pressure.

The energy losses, for example caused by friction, lead to the amount of travel being reduced. In order to compensate for this, new energy must be supplied. To that end, the channel 36 is placed into communication with the space 18 as soon as the piston starts to move from the stable first position, so that gas will not flow to a third reservoir (not shown). On account of the lower pressure it effects, said discharged gas gives the piston 16 the required additional kinetic energy.

If the process in which the valve 7 operates is such that kinetic energy is supplied to the valve 7, it will be necessary to extract energy from the piston 16. As a result, gas will flow into the piston chamber 18 via the channel 36 during the movement of the piston 16, and the piston 16 will experience a higher counterpressure during its return movement, due to a higher gas pressure.

If the valve 7 is released sufficiently quickly by the cylinder 22 of the locking means, the valve 7 will make a free, damped oscillating movement. The angle that the guideway 21 includes with the longitudinal direction of the valve 7 determines the magnitude of the rotational force that the cylinder 22 experiences as a result of the impulse force. Near the stable situation, said angle is small enough to prevent the rotational force from rotating the cylinder 22 against the frictional force set up between the cylinder 22 and the housing part 3, 6. The guideway 21 is configured such that the rotational speed of the cylinder 22 will remain sufficiently high in the rotational range from 0 to 20 degrees when the piston speed decreases.

A control device (not shown) presets the desired first, second and third gas pressures in dependence on the process conditions, such as the number of revolutions, the load and the delivery pressure in the channel 40. The opening period of the valve and the supply and discharge of energy are thus determined. In a further embodiment, an additional control device is provided, which measures the rotation of the cylinder 22 in relation to the first position and which corrects the first control device in dependence on any differences that are found (feedback). A projection 24 for actuating the locking means is provided in the illustrated embodiment, which projection is given an impetus by a tappet (not shown), which is driven by a biased spring, for example, or by an electromagnet. Also other manners of rotating the cylinder 22 from the stable first position are conceivable, however. One advantage of the illustrated embodiment is the fact that the impetus is imparted in such a manner that the tappet will return after having struck the projection and allow the projection to return to the first position without impediment. Thus the start of the movement can be reproduced relatively accurately.

In a further embodiment (not shown) a second channel is formed in the wall of the cylinder 22, parallel to the channel 26, which second channel is in communication in the first position with a further reservoir (not shown) of lubricating oil or a fluid having the same effect. The pressure in said reservoir is at least equal to or higher than the second gas pressure. When the cylinder 22 is in the first position, the space 18 to the left of the piston 16 is in communication with the channel for lubricating oil in the cylinder 22, so that lubricating oil can flow into the space 18. The channel for lubricating oil is closed by the cylinder 22 upon rotation of the cylinder 22. Any excess of lubricating oil can be discharged via the channel 26 when the cylinder 22 is in the first position.

The invention claimed is:

1. A valve gear comprising a housing provided with a passage, a valve member arranged within said housing, which is movable between a first, closed position, in which the passage is closed, and a second, open position, a piston connected to the valve member, which can oscillate in an at least substantially closed piston chamber, and locking means which are capable of holding the valve member periodically in the closed position, wherein the piston chamber is provided with at least three closable openings, which may each be in communication with gas pressure means, wherein the first opening and the second opening are each in communication with another part of the piston chamber separated therefrom by the piston, and which are open when the valve member is held in the closed position, and wherein the third opening is open during movement of the piston.

2. A valve gear according to claim 1, wherein the locking means comprise a projection and a curved guideway, which are movable relative to each other, wherein the part of the guideway against which the projection abuts in the closed position of the valve member extends substantially transversely to the direction of movement of the valve member, in such a manner that the movement of the valve member is blocked.

3. A valve gear according to claim 2, wherein the piston chamber and the valve member are present in separate parts of the housing, which housing parts are resiliently connected.

4. A valve gear according to claim 2, wherein the locking means comprise a tappet, which is capable of striking against the projection and/or the guideway to release the locked position thereof.

5. A valve gear according to claim 4, wherein the guideway is formed in a rotatable sleeve, which can rotate around a stem within the housing, with the stem linking the valve member and the piston together.

6. A valve gear according to claim 4, wherein the piston chamber and the valve member are present in separate parts of the housing, which housing parts are resiliently connected.

7. A valve gear according to claim 2, wherein the guideway is formed in a rotatable sleeve, which can rotate around a stem within the housing, with the stem linking the valve member and the piston together.

8. A valve gear according to claim 7, wherein the piston chamber and the valve member are present in separate parts of the housing, which housing parts are resiliently connected.

9. A valve gear according to claim 1, wherein the piston chamber and the valve member are present in separate parts of the housing, which housing parts are resiliently connected.

10. A valve gear according to claim 9, wherein the two housing parts are connected by means of an elastic ring.

* * * * *